US011045921B2

(12) United States Patent
Kimba et al.

(10) Patent No.: US 11,045,921 B2
(45) Date of Patent: Jun. 29, 2021

(54) POLISHING APPARATUS AND POLISHING METHOD

(71) Applicant: EBARA CORPORATION, Tokyo (JP)

(72) Inventors: Toshifumi Kimba, Tokyo (JP); Masaki Kinoshita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 428 days.

(21) Appl. No.: 15/979,180

(22) Filed: May 14, 2018

(65) Prior Publication Data

US 2018/0339392 A1 Nov. 29, 2018

(30) Foreign Application Priority Data

May 17, 2017 (JP) ..... JP2017-098254

(51) Int. Cl.

| | |
|---|---|
| ***B24B 37/005*** | (2012.01) |
| ***B24B 49/12*** | (2006.01) |
| ***B24B 37/04*** | (2012.01) |
| ***B24B 37/20*** | (2012.01) |
| ***B24B 37/013*** | (2012.01) |

(52) U.S. Cl.

CPC ..... *B24B 37/005* (2013.01); *B24B 37/013* (2013.01); *B24B 37/042* (2013.01); *B24B 37/20* (2013.01); *B24B 37/205* (2013.01); *B24B 49/12* (2013.01)

(58) Field of Classification Search

CPC ... B24B 37/005; B24B 37/013; B24B 37/205; B24B 37/042; B24B 37/20

See application file for complete search history.

(56) References Cited

U.S. PATENT DOCUMENTS 7,304,744 B1 12/2007 Hatanaka et al.
8,025,759 B2 * 9/2011 Sasaki ..... B24B 49/03 156/345.13

(Continued)

FOREIGN PATENT DOCUMENTS

CN 101995224 A 3/2011
CN 104275642 A 1/2015

(Continued)

OTHER PUBLICATIONS

STIC search results. (Year: 2020).*
Singapore Patent Application No. 10201803980X; Search Report and Examination Report; dated Jul. 15, 2020; 7 pages.

*Primary Examiner* — Monica S Carter
*Assistant Examiner* — Alberto Saenz
(74) *Attorney, Agent, or Firm* — BakerHostetler

(57) ABSTRACT

A polishing apparatus capable of accurately determining a service life of a light source, and further capable of accurately measuring a film thickness of a substrate, such as a wafer, without calibrating an optical film-thickness measuring device, is disclosed. The polishing apparatus includes a spectrometer configured to decompose reflected light from a substrate in accordance with wavelength and measure an intensity of the reflected light at each of wavelengths a film thickness of the substrate is determined based on a spectral waveform indicating a relationship between the intensity of the reflected light and wavelength. An optical-path selecting mechanism is configured to selectively couple either a light-receiving fiber or an internal optical fiber to the spectrometer.

18 Claims, 6 Drawing Sheets

(56) References Cited

U.S. PATENT DOCUMENTS

| | | | | |
|---|---|---|---|---|
| 8,535,115 | B2 * | 9/2013 | David | B24B 37/105 451/6 |
| 8,694,144 | B2 * | 4/2014 | Duboust | H01L 22/26 700/121 |
| 2002/0115380 | A1 | 8/2002 | Yamane et al. | |
| 2012/0053717 | A1 | 3/2012 | Duboust et al. | |
| 2012/0164917 | A1 * | 6/2012 | Kobata | B24B 37/005 451/6 |
| 2012/0196511 | A1 | 8/2012 | David et al. | |
| 2015/0017887 | A1 | 1/2015 | Kobayashi et al. | |
| 2016/0354894 | A1 | 12/2016 | Kimba | |

FOREIGN PATENT DOCUMENTS

| | | | |
|---|---|---|---|
| CN | 104620071 | A | 5/2015 |
| CN | 104907921 | A | 9/2015 |
| CN | 105452801 | A | 3/2016 |
| CN | 105729307 | A | 7/2016 |
| CN | 106239352 | A | 12/2016 |
| CN | 106304845 | A | 1/2017 |
| JP | 2001-044254 | A | 2/2001 |
| JP | 2009-302577 | A | 12/2009 |
| JP | 2017-005014 | A | 1/2017 |
| WO | WO 2005/004218 | A1 | 1/2005 |

* cited by examiner

POLISHING APPARATUS AND POLISHING METHOD

CROSS REFERENCE TO RELATED APPLICATION

This document claims priority to Japanese Patent Application No. 2017-98254 filed May 17, 2017, the entire contents of which are hereby incorporated by reference.

BACKGROUND

Manufacturing processes of semiconductor devices include a process of polishing a dielectric film, e.g., $SiO_2$, and a process of polishing a metal film, e.g., copper or tungsten. Manufacturing processes of backside illumination CMOS sensor and through-silicon via (TSV) include a process of polishing a silicon layer (silicon wafer), in addition to the polishing processes of the dielectric film and the metal film. Polishing of a wafer is terminated when a thickness of a film (e.g., the dielectric film, the metal film, or the silicon layer), constituting a wafer surface, has reached a predetermined target value.

Polishing of a wafer is carried out using a polishing apparatus. In order to measure a film thickness of a non-metal film, such as a dielectric film or a silicon layer, the polishing apparatus generally includes an optical film-thickness measuring device. This optical film-thickness measuring device is configured to direct a light, which is emitted from a light source, to a surface of the wafer, and to analyze a spectrum of reflected light from the wafer to thereby detect the film thickness of the wafer.

A quantity of light emitted by the light source is gradually lowered with an operating time of the light source. Thus, when the quantity of light from the light source is lowered to a certain extent, it is necessary to calibrate the optical film-thickness measuring device. Further, before a service life of the light source is reached, the light source needs to be replaced with a new one. However, it takes a certain time to perform the calibration of the optical film-thickness measuring device. Beside, a tool for the calibration is needed. Moreover, the decrease in the quantity of light from the light source may be caused by factors other than the light source, and thus it is difficult to accurately determine the service life of the light source.

SUMMARY OF THE INVENTION

According to embodiments, there are provided a polishing apparatus and a polishing method capable of accurately determining a service life of a light source, and further capable of accurately measuring a film thickness of a substrate, such as a wafer, without calibrating an optical film-thickness measuring device.

Embodiments, which will be described below, relate to a polishing apparatus and a polishing method for polishing a wafer having a film forming a surface thereof, and more particularly to a polishing apparatus and a polishing method for polishing a wafer, while detecting a film thickness of the wafer by analyzing optical information contained in reflected light from the wafer.

In an embodiment, there is provided a polishing apparatus comprising: a polishing table for supporting a polishing pad; a polishing head configured to press a wafer against the polishing pad; a light source configured to emit light; an illuminating fiber having a distal end arranged at a predetermined position in the polishing table, the illuminating fiber being coupled to the light source; a spectrometer configured to decompose reflected light from the wafer in accordance with wavelength and measure an intensity of the reflected light at each of wavelengths; a light-receiving fiber having a distal end arranged at the predetermined position in the polishing table, the light-receiving fiber being coupled to the spectrometer; a processor configured to determine a film thickness of the wafer based on a spectral waveform indicating a relationship between the intensity of the reflected light and wavelength; an internal optical fiber coupled to the light source; and an optical-path selecting mechanism configured to selectively couple either the light-receiving fiber or the internal optical fiber to the spectrometer.

The processor stores therein, in advance, a correction formula for correcting the intensity of the reflected light, the correction formula being a function which includes, as variables, at least the intensity of the reflected light and an intensity of light transmitted to the spectrometer through the internal optical fiber.

The correction formula is represented by $$\text{a corrected intensity} = [E(\lambda) - D3(\lambda)] \Big/ \left[[B(\lambda) - D1(\lambda)] \times \frac{G(\lambda) - D3(\lambda)}{F(\lambda) - D2(\lambda)}\right]$$

where $E(\lambda)$ is an intensity of the reflected light at a wavelength $\lambda$, $B(\lambda)$ is a reference intensity at the wavelength $\lambda$ which is measured in advance, $D1(\lambda)$ is a dark level at the wavelength $\lambda$ obtained under a condition that light is cut off immediately before or immediately after the reference intensity $B(\lambda)$ is measured, $F(\lambda)$ is an intensity of the light at the wavelength $\lambda$ transmitted to the spectrometer through the internal optical fiber immediately before or immediately after the reference intensity $B(\lambda)$ is measured, $D2(\lambda)$ is a dark level at the wavelength $\lambda$ obtained under a condition that light is cut off immediately before or immediately after the intensity $F(\lambda)$ is measured, $G(\lambda)$ is an intensity of the light at the wavelength $\lambda$ transmitted to the spectrometer through the internal optical fiber before the intensity $E(\lambda)$ is measured, and $D3(\lambda)$ is a dark level at the wavelength $\lambda$ obtained under a condition that light is cut off before the intensity $E(\lambda)$ is measured, and immediately before or immediately after the intensity $G(\lambda)$ is measured.

The reference intensity $B(\lambda)$ is an intensity of the reflected light from a silicon wafer which is measured by the spectrometer when a silicon wafer with no film thereon is being water-polished in the presence of water on the polishing pad, or when a silicon wafer with no film thereon is placed on the polishing pad.

The reference intensity $B(\lambda)$ is an average of multiple values of intensity of the reflected light from the silicon wafer which have been measured under the same condition.

The processor instructs the optical-path selecting mechanism to couple the internal optical fiber to the spectrometer before the wafer is polished.

The processor is configured to generate an alarm signal when the intensity of light transmitted to the spectrometer through the internal optical fiber is lower than a threshold value.

The illuminating fiber has a plurality of distal ends arranged at different locations in the polishing table, and the light-receiving fiber has a plurality of distal ends arranged at the different locations in the polishing table.

The illuminating fiber has a plurality of first illuminating strand optical fibers and a plurality of second illuminating strand optical fibers, and light-source-side ends of the plurality of first illuminating strand optical fibers and light-source-side ends of the plurality of second illuminating strand optical fibers are distributed evenly around a center of the light source.

An average of distances from the center of the light source to the light-source-side ends of the plurality of first illuminating strand optical fibers is equal to an average of distances from the center of the light source to the light-source-side ends of the plurality of second illuminating strand optical fibers.

A light-source-side end of the internal optical fiber is located at the center of the light source.

A part of the plurality of first illuminating strand optical fibers, a part of the plurality of second illuminating strand optical fibers, and a part of the internal optical fiber constitute a trunk fiber bound by a binder, and other part of the plurality of first illuminating strand optical fibers, other part of the plurality of second illuminating strand optical fibers, and other part of the internal optical fiber constitute branch fibers which branch off from the trunk fiber.

There is provided a polishing method comprising: directing light from a light source to a spectrometer through an internal optical fiber to measure an intensity of the light, the light source being coupled to the spectrometer through the internal optical fiber, pressing a wafer against a polishing pad on a polishing table to polish the wafer, during polishing of the wafer, directing light to the wafer and measuring an intensity of reflected light from the wafer; correcting the intensity of reflected light from the wafer based on the intensity of light transmitted to the spectrometer through the internal optical fiber; and determining a film thickness of the wafer based on a spectral waveform indicating a relationship between the corrected intensity and wavelength of light.

The intensity of reflected light from the wafer is corrected with use of a correction formula represented by $$\text{the corrected intensity} = [E(\lambda) - D3(\lambda)] \Big/ \left[[B(\lambda) - D1(\lambda)] \times \frac{G(\lambda) - D3(\lambda)}{F(\lambda) - D2(\lambda)}\right]$$

where $E(\lambda)$ is an intensity of the reflected light at a wavelength $\lambda$, $B(\lambda)$ is a reference intensity at the wavelength $\lambda$ which is measured in advance, $D1(\lambda)$ is a dark level at the wavelength $\lambda$ obtained under a condition that light is cut off immediately before or immediately after the reference intensity $B(\lambda)$ is measured, $F(\lambda)$ is an intensity of the light at the wavelength $\lambda$ transmitted to the spectrometer through the internal optical fiber immediately before or immediately after the reference intensity $B(\lambda)$ is measured, $D2(\lambda)$ is a dark level at the wavelength $\lambda$ obtained under a condition that light is cut off immediately before or immediately after the intensity $F(\lambda)$ is measured, $G(\lambda)$ is an intensity of the light at the wavelength $\lambda$ transmitted to the spectrometer through the internal optical fiber before the intensity $E(\lambda)$ is measured, and $D3(\lambda)$ is a dark level at the wavelength $\lambda$ obtained under a condition that light is cut off before the intensity $E(\lambda)$ is measured, and immediately before or immediately after the intensity $G(\lambda)$ is measured.

The reference intensity $B(\lambda)$ is an intensity of the reflected light from a silicon wafer which is measured by the spectrometer when a silicon wafer with no film thereon is being water-polished in the presence of water on the polishing pad, or when a silicon wafer with no film thereon is placed on the polishing pad.

The reference intensity $B(\lambda)$ is an average of multiple values of intensity of the reflected light from the silicon wafer which have been measured under the same condition.

The process of directing the light from the light source to the spectrometer through the internal optical fiber to measure the intensity of light is performed before polishing of the wafer.

The polishing method further comprises generating an alarm signal when the intensity of light transmitted to the spectrometer through the internal optical fiber is lower than a threshold value.

If the intensity of the light is lower than the threshold value, the wafer is returned to a substrate cassette without performing polishing of the wafer.

According to the above-described embodiments, the light emitted by the light source is transmitted to the spectrometer through the internal optical fiber. Because the light is directly transmitted to the spectrometer without being directed to the wafer, the processor can accurately determine the service life of the light source based on the intensity of light measured by the spectrometer. Further, the processor corrects the intensity of the reflected light from the wafer during polishing of the wafer with use of the intensity of light transmitted to the spectrometer through the internal optical fiber, i.e., an internal monitoring intensity. Since the corrected intensity of the reflected light contains correct optical information of the wafer, the processor can determine an accurate film thickness of the wafer.

DESCRIPTION OF EMBODIMENTS

Figure 1:
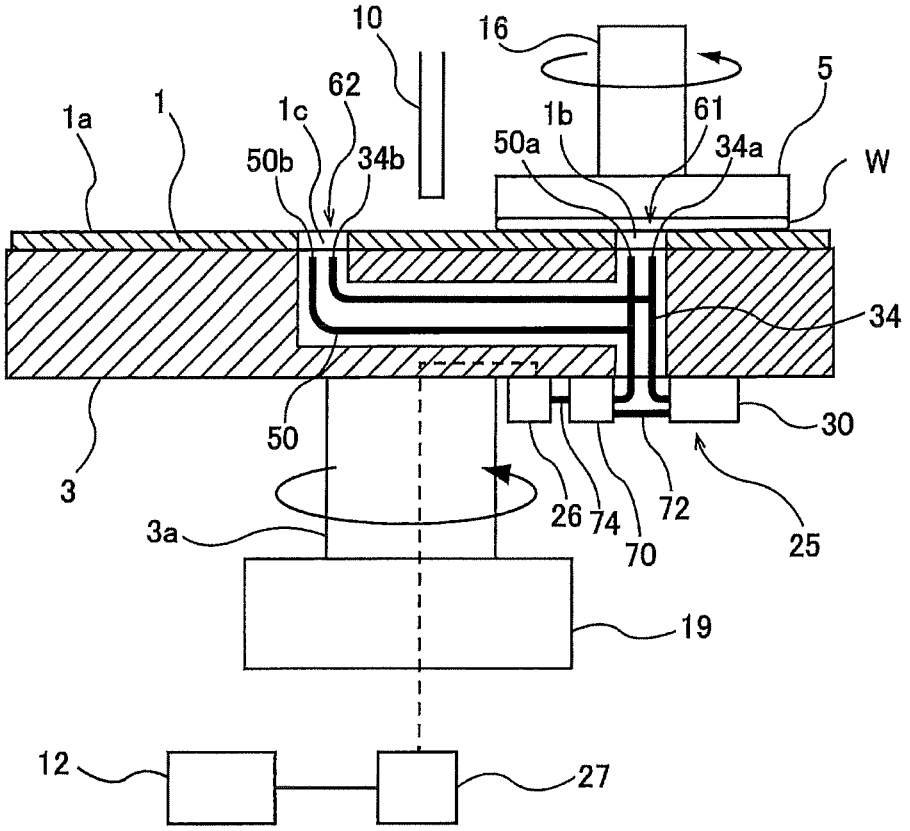
FIG. 1 is a view showing an embodiment of a polishing apparatus.

Embodiments will be described below with reference to the drawings. FIG. 1 is a view showing an embodiment of a polishing apparatus. As shown in FIG. 1, the polishing apparatus includes a polishing table 3 supporting a polishing pad 1, a polishing head 5 for holding a wafer W and pressing the wafer W against the polishing pad 1 on the polishing table 3, a polishing-liquid supply nozzle 10 for supplying a polishing liquid (e.g., slurry) onto the polishing pad 1, and a polishing controller 12 for controlling polishing of the wafer W.

The polishing table 3 is coupled to a table motor 19 through a table shaft 3*a*, so that the polishing table 3 is rotated by the table motor 19 in a direction indicated by arrow. The table motor 19 is located below the polishing table 3. The polishing pad 1 is attached to an upper surface of the polishing table 3. The polishing pad 1 has an upper surface, which provides a polishing surface 1*a* for polishing the wafer W. The polishing head 5 is secured to a lower end of a polishing head shaft 16. The polishing head 5 is configured to be able to hold the wafer W on its lower surface by vacuum suction. The polishing head shaft 16 can be elevated and lowered by an elevating mechanism (not shown in the drawing).

Polishing of the wafer W is performed as follows. The polishing head 5 and the polishing table 3 are rotated in directions indicated by arrows, while the polishing liquid (or slurry) is supplied from the polishing-liquid supply nozzle 10 onto the polishing pad 1. In this state, the polishing head 5 presses the wafer W against the polishing surface 1*a* of the polishing pad 1. The surface of the wafer W is polished by a chemical action of the polishing liquid and a mechanical action of abrasive grains contained in the polishing liquid.

The polishing apparatus includes an optical film-thickness measuring device (i.e., a film thickness measuring apparatus) 25 for measuring a film thickness of the wafer W. This optical film-thickness measuring device 25 includes a light source 30 for emitting light, an illuminating fiber 34 having distal ends 34*a*, 34*b* arranged at different locations in the polishing table 3, a light-receiving fiber 50 having distal ends 50*a*, 50*b* arranged at the different locations in the polishing table 3, a spectrometer 26 for decomposing reflected light from the wafer W in accordance with wavelength and measuring an intensity of the reflected light at each of wavelengths, and a processor 27 for producing a spectral waveform indicating a relationship between the intensity and the wavelength of the reflected light. The processor 27 is coupled to the polishing controller 12.

The illuminating fiber 34 is coupled to the light source 30 and is arranged so as to direct the light, emitted by the light source 30, to the surface of the wafer W. The light-receiving fiber 50 is coupled to an optical-path selecting mechanism 70. One end of an internal optical fiber 72 is coupled to the light source 30, while the other end of the internal optical fiber 72 is coupled to the optical-path selecting mechanism 70. Further, the optical-path selecting mechanism 70 is coupled to the spectrometer 26 through a connecting optical fiber 74.

The optical-path selecting mechanism 70 is configured to optically couple either the light-receiving fiber 50 or the internal optical fiber 72 to the spectrometer 26 through the connecting optical fiber 74. More specifically, when the optical-path selecting mechanism 70 is activated to optically couple the light-receiving fiber 50 to the spectrometer 26, the reflected light from the wafer W is transmitted to the spectrometer 26 through the light-receiving fiber 50, the optical-path selecting mechanism 70, and the connecting optical fiber 74. When the optical-path selecting mechanism 70 is activated to optically couple the internal optical fiber 72 to the spectrometer 26, the light emitted by the light source 30 is transmitted to the spectrometer 26 through the internal optical fiber 72, the optical-path selecting mechanism 70, and the connecting optical fiber 74. Operations of the optical-path selecting mechanism 70 are controlled by the processor 27.

Examples of the optical-path selecting mechanism 70 include an optical switch. The optical switch may be of a type which has an actuator for moving a first optical path to selectively couple the first optical path to at least one of second optical paths, or may be a type which has a shutter for blocking at least one of second optical paths coupled to first optical paths, respectively.

The distal end 34*a* of the illuminating fiber 34 and the distal end 50*a* of the light-receiving fiber 50 are adjacent to each other. These distal ends 34*a*, 50*a* constitute a first optical sensor 61. The other distal end 34*b* of the illuminating fiber 34 and the other distal end 50*b* of the light-receiving fiber 50 are adjacent to each other. These distal ends 34*b*, 50*b* constitute a second optical sensor 62. The polishing pad 1 has through-holes 1*b*, 1*c* located above the first optical sensor 61 and the second optical sensor 62, respectively. The first optical sensor 61 and the second optical sensor 62 can transmit the light to the wafer W on the polishing pad 1 through the through-holes 1*b*, 1*c* and can receive the reflected light from the wafer W through the through-holes 1*b*, 1*c*.

In one embodiment, the illuminating fiber 34 may have only one distal end arranged at a predetermined position in the polishing table 3, and the light-receiving fiber 50 may also have only one distal end arranged at the predetermined position in the polishing table 3. In this case also, the distal end of the illuminating fiber 34 and the distal end of the light-receiving fiber 50 are adjacent to each other. The distal end of the illuminating fiber 34 and the distal end of the light-receiving fiber 50 constitute an optical sensor for transmitting the light to the wafer W on the polishing pad 1, and receiving the reflected light from the wafer W.

Figure 2:
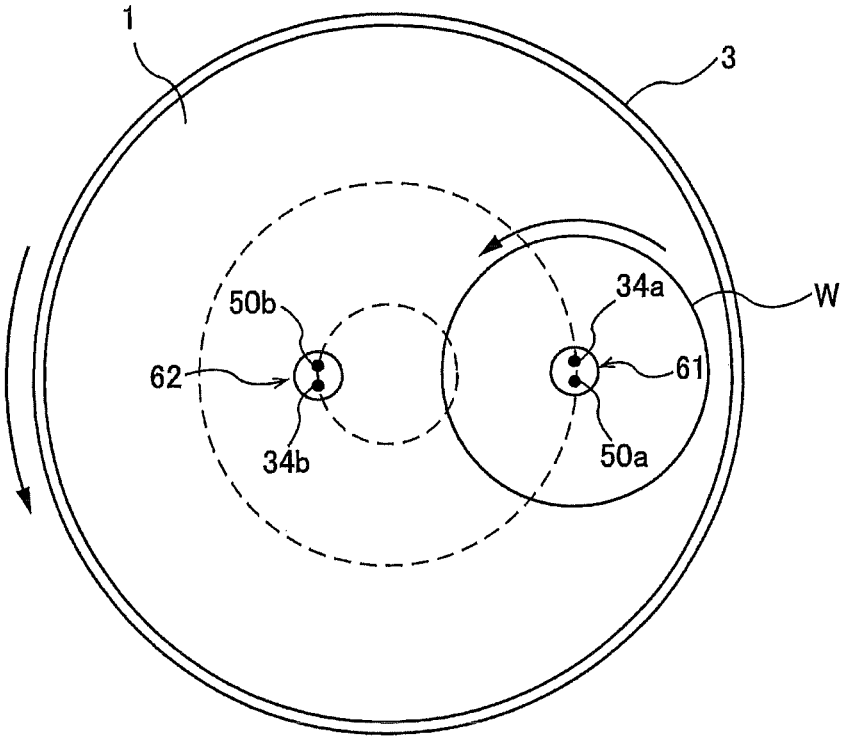
FIG. 2 is a plan view showing a polishing pad and a polishing table.

FIG. 2 is a plan view showing the polishing pad 1 and the polishing table 3. The first optical sensor 61 and the second optical sensor 62 are located at different distances from a center of the polishing table 3, and are arranged away from each other in the circumferential direction of the polishing pad 3. In the embodiment shown in FIG. 2, the second optical sensor 62 is located across the center of the polishing table 3 from the first optical sensor 61. The first optical sensor 61 and the second optical sensor 62 move across the wafer W alternately in different paths each time the polishing table 3 makes one revolution. More specifically, the first optical sensor 61 sweeps across the center of the wafer W, while the second optical sensor 62 sweeps across only the edge portion of the wafer W. The first optical sensor 61 and the second optical sensor 62 direct the light to the wafer W alternately, and receive the reflected light from the wafer W alternately.

Figure 3:
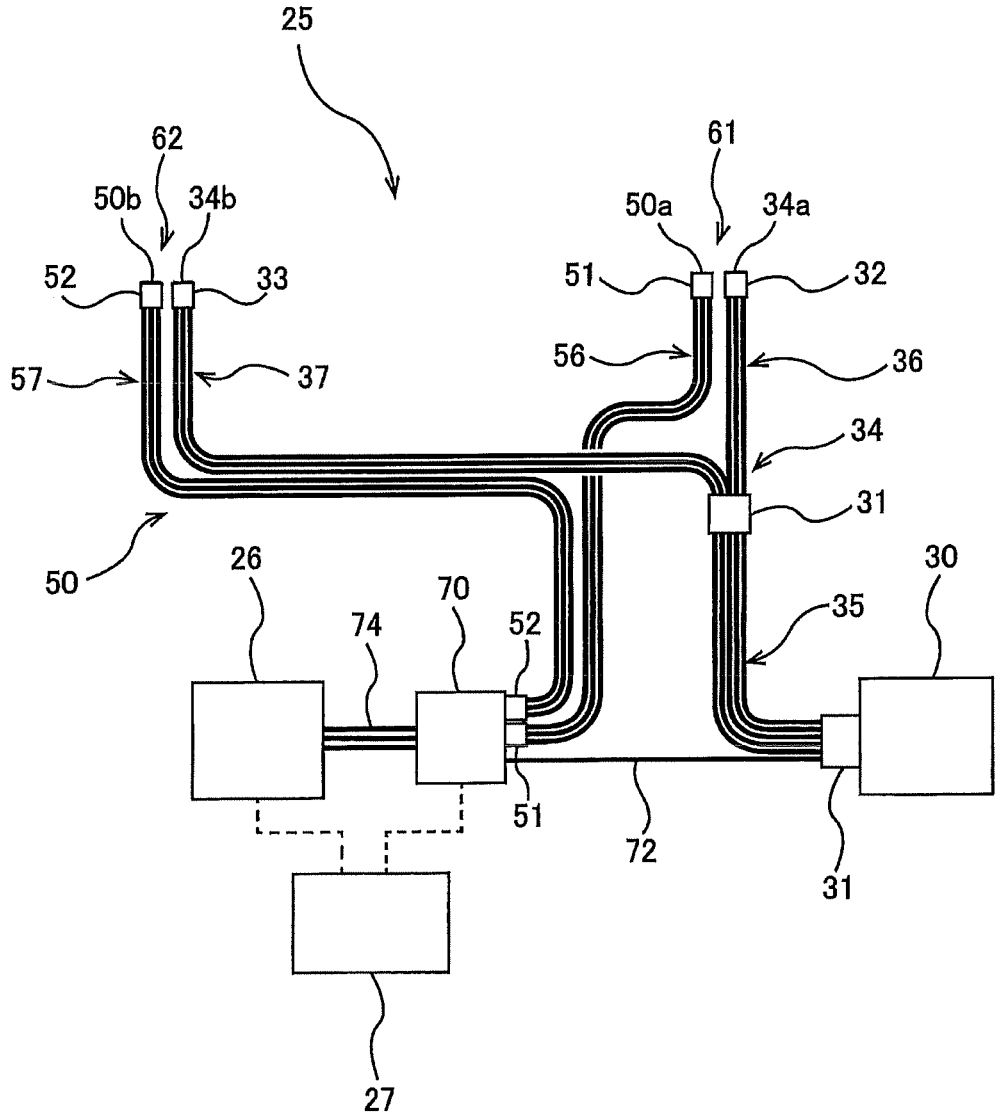
FIG. 3 is an enlarged view showing an optical film-thickness measuring device (film-thickness measuring apparatus)

FIG. 3 is an enlarged view showing the optical film-thickness measuring device (i.e., the film-thickness measuring apparatus) 25. The illuminating fiber 34 has a plurality of first illuminating strand optical fibers 36 and a plurality of second illuminating strand optical fibers 37. Distal ends of the first illuminating strand optical fibers 36 and distal ends of the second illuminating strand optical fibers 37 are bound by binders 32, 33, respectively. These distal ends constitute the distal ends 34*a*, 34*b* of the illuminating fiber 34.

Light-source-side ends of the first illuminating strand optical fibers 36, light-source-side ends of the second illuminating strand optical fibers 37, and a light-source-side end of the internal optical fiber 72 are coupled to the light source 30. A part of the first illuminating strand optical fibers 36, a part of the second illuminating strand optical fibers 37, and a part of the internal optical fiber 72 constitute a trunk fiber 35 bound by a binder 31. The trunk fiber 35 is coupled to the light source 30. The other part of the first illuminating strand optical fibers 36, the other part of the second illuminating strand optical fibers 37, and the other part of the internal optical fiber 72 constitute branch fibers which branch off from the trunk fiber 35.

In the embodiment shown in FIG. 3, three branch fibers branch off from one trunk fiber 35. Four or more branch fibers can branch off by adding strand optical fibers. Further, a diameter of the fiber can be easily increased by adding strand optical fibers. Such a fiber constituted by the plurality of strand optical fibers has advantages that it can be easily bent and is not easily broken.

The light-receiving fiber 50 includes a plurality of first light-receiving strand optical fibers 56 bound by a binder 51, and a plurality of second light-receiving strand optical fibers 57 bound by a binder 52. The distal ends 50*a*, 50*b* of the light-receiving fiber 50 is constituted by distal ends of the first light-receiving strand optical fibers 56 and distal ends of the second light-receiving strand optical fibers 57, respectively. The distal end 34*a* of the first illuminating strand optical fibers 36 and the distal end 50*a* of the first light-receiving strand optical fibers 56 constitute the first optical sensor 61. The distal end 34*b* of the second illuminating strand optical fibers 37 and the distal end 50*b* of the second light-receiving strand optical fibers 57 constitute the second optical sensor 62. Opposite ends of the first light-receiving strand optical fibers 56 and the second light-receiving strand optical fibers 57 are coupled to the optical-path selecting mechanism 70.

The optical-path selecting mechanism 70 and the spectrometer 26 are electrically coupled to the processor 27. The optical-path selecting mechanism 70 is operated by the processor 27. When the wafer W is to be polished, the processor 27 operates the optical-path selecting mechanism 70 to optically couple the light-receiving fiber 50 to the spectrometer 26. More specifically, each time the polishing table 3 makes one revolution, the processor 27 operates the optical-path selecting mechanism 70 to couple the first light-receiving strand optical fibers 56 and the second light-receiving strand optical fibers 57 alternately to the spectrometer 26. The first light-receiving strand-optical fiber 56 are coupled to the spectrometer 26 while the distal end 50*a* of the first light-receiving branch fibers 56 are present under the wafer W, and the second light-receiving strand optical fibers 57 are coupled to the spectrometer 26 while the distal end 50*b* of the second light-receiving branch fiber 57 are present under the wafer W.

In the present embodiment, the optical-path selecting mechanism 70 is configured to optically couple any one of the first light-receiving strand optical fibers 56, the second light-receiving strand optical fibers 57, and the internal optical fiber 72 to the spectrometer 26. This structure makes it possible to transmit only the reflected light from the wafer W to the spectrometer 26, and as a result, an accuracy of the film-thickness measuring operation is improved. In one embodiment, the optical-path selecting mechanism 70 may be configured to optically couple either the light-receiving strand optical fibers 56, 57 or the internal optical fiber 72 to the spectrometer 26. In this case, during polishing of the wafer W, the reflected light is transmitted to the spectrometer 26 through both of the light-receiving strand optical fibers 56, 57. Since intensities of light other than the reflected light from the wafer W are extremely low, it is possible to measure an accurate film thickness by using only light having intensities that are greater than or equal to a threshold value.

During polishing of the wafer W, the illuminating fiber 34 directs the light to the wafer W, and the light-receiving fiber 50 receives the reflected light from the wafer W. The reflected light from the wafer W is transmitted to the spectrometer 26. The spectrometer 26 decomposes the reflected light in accordance with wavelength, measures the intensity of the reflected light at each of the wavelengths over a predetermined wavelength range, and transmits light intensity data obtained to the processor 27. This light intensity data is an optical signal reflecting a film thickness of the wafer W, and contains the intensities of the reflected light and the corresponding wavelengths. The processor 27 produces, from the light intensity data, the spectral waveform representing the intensity of the light at each of the wavelengths.

Figure 4:
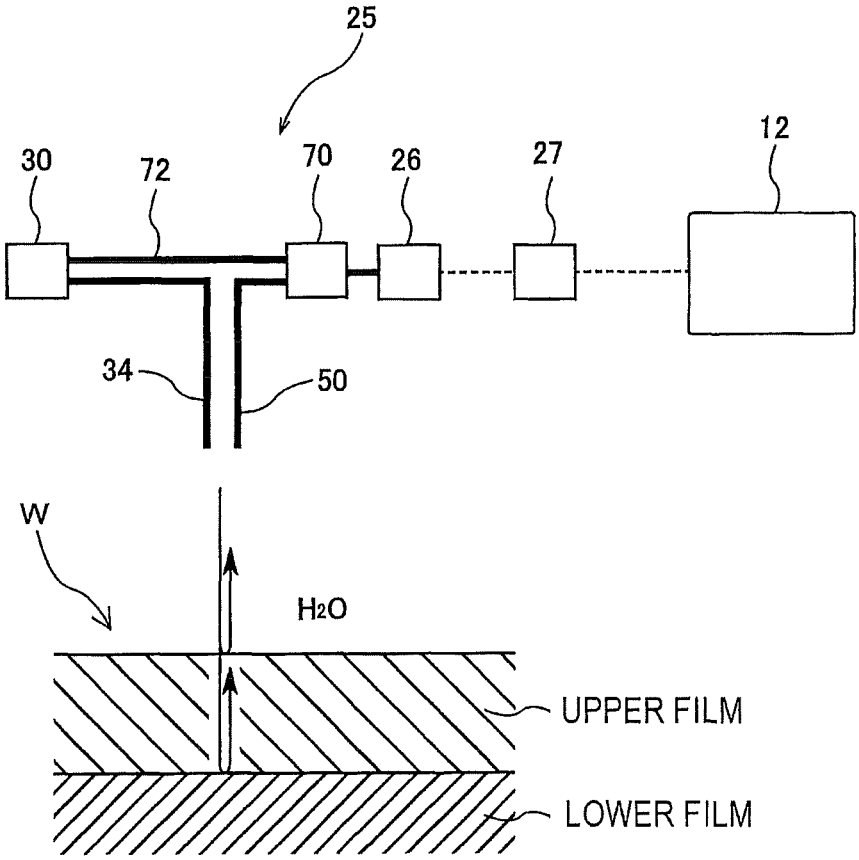
FIG. 4 is a schematic view illustrating the principle of the optical film-thickness measuring device.

FIG. 4 is a schematic view illustrating the principle of the optical film-thickness measuring device 25. In this example shown in FIG. 4, a wafer W has a lower film and an upper film formed on the lower film. The upper film is a film that can allow light to pass therethrough, such as a silicon layer or a dielectric film. The light, directed to the wafer W, is reflected off an interface between a medium (e.g., water in the example of FIG. 4) and the upper film and an interface between the upper film and the lower film. Light waves from these interfaces interfere with each other. The manner of interference between the light waves varies according to the thickness of the upper film (i.e., a length of an optical path). As a result, the spectral waveform, produced from the reflected light from the wafer W, varies according to the thickness of the upper film.

The spectrometer 26 decomposes the reflected light in accordance with the wavelength and measures the intensity of the reflected light at each of the wavelengths. The processor 27 produces the spectral waveform from the reflected-light intensity data (or optical signal) obtained by the spectrometer 26. This spectral waveform is expressed as a line graph indicating a relationship between the wavelength and the intensity of the light. The intensity of the light can also be expressed as a relative value, such as a relative reflectance which will be discussed later.

Figure 5:
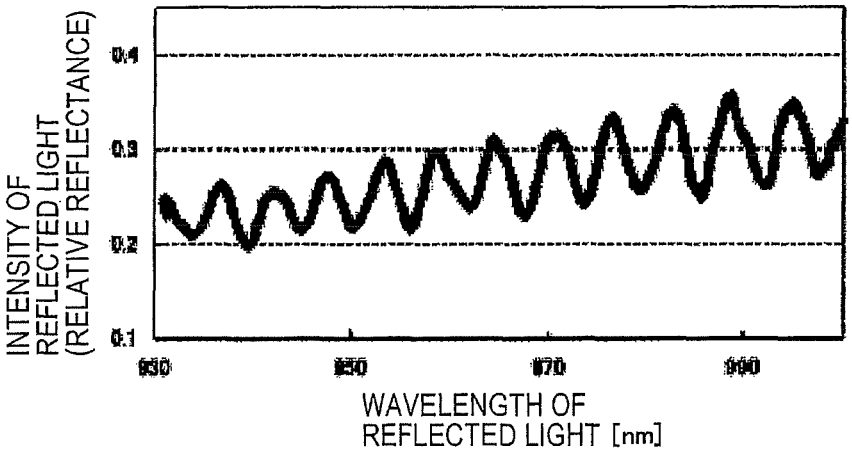
FIG. 5 is a graph showing an example of a spectral waveform.

FIG. 5 is a graph showing an example of the spectral waveform. In FIG. 5, vertical axis represents relative reflectance indicating the intensity of the reflected light from the wafer W, and horizontal axis represents wavelength of the reflected light. The relative reflectance is an index value that represents the intensity of the reflected light. The relative reflectance is a ratio of the intensity of the light to a predetermined reference intensity. By dividing the intensity of the light (i.e., the actually measured intensity) at each wavelength by a predetermined reference intensity, unwanted noises, such as a variation in the intensity inherent in an optical system or the light source of the apparatus, are removed from the actually measured intensity.

The reference intensity is an intensity that has been measured in advance at each of the wavelengths. The relative reflectance is calculated at each of the wavelengths. Specifically, the relative reflectance is determined by dividing the intensity of the light (the actually measured intensity) at each wavelength by the corresponding reference intensity. The reference intensity is, for example, obtained by directly measuring the intensity of light emitted from the first optical sensor 61 or the second optical sensor 62, or by irradiating a mirror with light from the first optical sensor 61 or the second optical sensor 62 and measuring the intensity of reflected light from the mirror. Alternatively, the reference intensity may be an intensity of the reflected light which is measured by the spectrometer 26 when a silicon wafer (bare wafer) with no film thereon is being water-polished in the presence of water, or when the silicon wafer (bare wafer) is placed on the polishing pad 1. In the actual polishing process, a dark level (which is a background intensity obtained under the condition that light is cut off) is subtracted from the actually measured intensity to determine a corrected actually measured intensity. Further, the dark level is subtracted from the reference intensity to determine a corrected reference intensity. Then the relative reflectance is calculated by dividing the corrected actually measured intensity by the corrected reference intensity. That is, the relative reflectance R(λ) can be calculated by using the following formula (1)

$$R(\lambda) = \frac{E(\lambda) - D(\lambda)}{B(\lambda) - D(\lambda)} \quad (1)$$

where λ is wavelength, E(λ) is the intensity of the light reflected from the wafer at the wavelength λ, B(λ) is the reference intensity at the wavelength λ, and D(λ) is the background intensity (i.e., dark level) at the wavelength 1 obtained under the condition that light is cut off.

Figure 6:
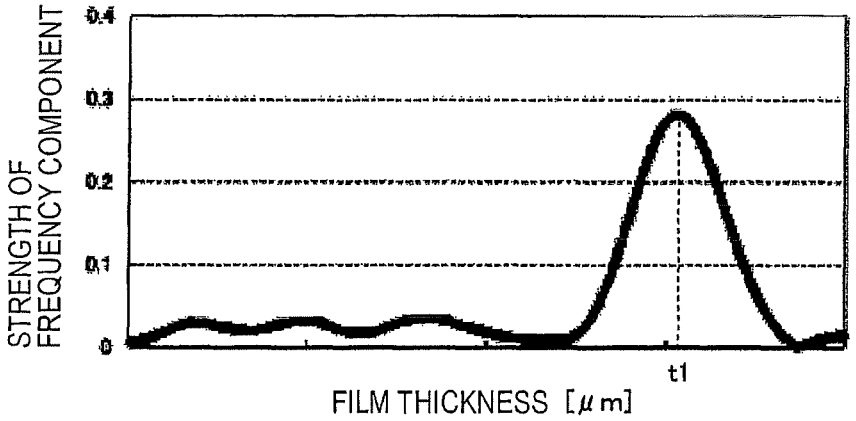
FIG. 6 is a graph showing a frequency spectrum obtained by performing Fourier transform process on the spectral waveform shown in FIG. 5.

The processor 27 performs a Fourier transform process (e.g., fast Fourier transform process) on the spectral waveform to produce a frequency spectrum and determines a film thickness of the wafer W from the frequency spectrum. FIG. 6 is a graph showing the frequency spectrum obtained by performing the Fourier transform process on the spectral waveform shown in FIG. 5. In FIG. 6, vertical axis represents strength of a frequency component contained in the spectral waveform, and horizontal axis represents film thickness. The strength of a frequency component corresponds to amplitude of a frequency component which is expressed as sine wave. A frequency component contained in the spectral waveform is converted into a film thickness with use of a predetermined relational expression, so that the frequency spectrum as shown in FIG. 6 is produced. This frequency spectrum represents a relationship between the film thickness and the strength of the frequency component. The above-mentioned predetermined relational expression is a linear function representing the film thickness and having the frequency component as variable. This linear function can be obtained from actual measurement results of film thickness, an optical film-thickness measurement simulation, etc.

In the graph shown in FIG. 6, a peak of the strength of the frequency component appears at a film thickness t1. In other words, the strength of the frequency component becomes maximum at the film thickness of t1. That is, this frequency spectrum indicates that the film thickness is t1. In this manner, the processor 27 determines the film thickness corresponding to a peak of the strength of the frequency component.

The processor 27 outputs the film thickness t1 as a film-thickness measurement value to the polishing controller 12. The polishing controller 12 controls polishing operations (e.g., a polishing terminating operation) based on the film thickness t1 sent from the processor 27. For example, when the film thickness t1 has reached a preset target value, the polishing controller 12 terminates polishing of the wafer W.

As described above, the optical film-thickness measuring device 25 directs the light, emitted by the light source 30, to the wafer W, and determines the film thickness of the wafer W by analyzing the reflected light from the wafer W. However, a quantity of light emitted by the light source 30 is gradually lowered with an operating time of the light source 30. As a result, an error between a true film thickness and a measured film thickness becomes larger. Thus, in this embodiment, the optical film-thickness measuring device 25 is configured to correct the intensity of the reflected light from the wafer W based on the intensity of light transmitted to the spectrometer 26 through the internal optical fiber 72, and compensate for the decrease in the quantity of light of the light source 30.

The processor 27 calculates a corrected intensity of the reflected light with use of the following correction formula (2), instead of the aforementioned formula (1).

$$R'(\lambda) = [E(\lambda) - D3(\lambda)] \Big/ \left[[B(\lambda) - D1(\lambda)] \times \frac{G(\lambda) - D3(\lambda)}{F(\lambda) - D2(\lambda)}\right] \quad (2)$$

where R(λ) represents a corrected intensity of the reflected light, i.e., a corrected relative reflectance, E(λ) represents an intensity of reflected light from the wafer W being polished at a wavelength λ, B(λ) represents a reference intensity at the wavelength λ, D1(λ) represents a dark level at the wavelength λ measured under a condition that light is cut off immediately before or immediately after the reference intensity B(λ) is measured, F(λ) represents an intensity of light at the wavelength λ transmitted to the spectrometer 26 through the internal optical fiber 72 immediately before or immediately after the reference intensity B(λ) is measured, D2(λ) represents a dark level at the wavelength λ obtained under a condition that light is cut off immediately before or immediately after the intensity F(λ) is measured, G(λ) represents an intensity of light at the wavelength (λ) transmitted to the spectrometer 26 through the internal optical fiber 72 before the intensity E(λ) is measured, and D3(λ) represents a dark level at the wavelength λ obtained under a condition that light is cut off before the intensity E(λ) is measured, and immediately before or immediately after the intensity G(λ) is measured.

E(λ), B(λ), D1(λ), F(λ), D2(λ), G(λ), and D3(λ) are measured at each of the wavelengths within a predetermined wavelength range. The light-cut-off environment for measuring the dark levels D1(λ), D2(λ), and D3(λ) can be produced by cutting off the light with a shutter (not shown) installed in the spectrometer 26.

The processor 27 stores therein, in advance, the aforementioned correction formula (2) for correcting the intensity of the reflected light from the wafer W. This correction formula is a function including, as variables, at least the intensity of the reflected light from the wafer W, and the intensity of the light transmitted to the spectrometer 26 through the internal optical fiber 72. The reference intensity B(λ) is an intensity of light that has been measured in advance at each of wavelengths. For example, the reference intensity B(λ) is obtained by directly measuring the intensity of light emitted from the first optical sensor 61 or the second optical sensor 62, or by irradiating a mirror with light from the first optical sensor 61 or the second optical sensor 62 and measuring the intensity of reflected light from the mirror. Alternatively, the reference intensity B(λ) may be an intensity of the reflected light measured by the spectrometer 26 when a silicon wafer (bare wafer) with no film thereon is being water-polished in the presence of water, or when said silicon wafer (bare wafer) is placed on the polishing pad 1. In order to obtain a connect value of the reference intensity B(λ), the reference intensity B(λ) may be an average of multiple values of intensity of the light which have been measured under the same condition.

The reference intensity B(λ), the dark level D1(λ), the intensity F(λ), and the dark level D2(λ) are measured in advance, and inputted as constants into the aforementioned correction formula in advance. The intensity E(λ) is measured during polishing of the wafer W. The intensity G(λ) and the dark level D3(λ) are measured before polishing of the wafer W (preferably, immediately before polishing of the wafer W). For example, before the wafer W is held by the polishing head 5, the processor 27 operates the optical-path selecting mechanism 70 to couple the internal optical fiber 72 to the spectrometer 26 so that the light emitted by the light source 30 is transmitted to the spectrometer 26 through the internal optical fiber 72. The spectrometer 26 measures the intensity G(λ) and the dark level D3(λ), and sends these measured values to the processor 27. The processor 27 inputs the measured values of the intensity G(λ) and the dark level D3(λ) into the aforementioned correction formula. Upon completion of measuring of the intensity G(λ) and the dark level D3(λ), the processor 27 operates the optical-path selecting mechanism 70 to couple the light-receiving fiber 50 to the spectrometer 26. Thereafter, the wafer W is polished, and the intensity E(λ) is measured by the spectrometer 26 during polishing of the wafer W.

During polishing of the wafer W, the processor 27 inputs the measured value of the intensity E(λ) into the aforementioned correction formula, and calculates the corrected relative reflectance R'(λ) at each of wavelengths. More specifically, the processor 27 calculates corrected relative reflectances R'(λ) over the predetermined wavelength range. Therefore, the processor 27 can produce a spectral waveform representing a relationship between the corrected relative reflectance (i.e., the corrected intensity of the light) and the wavelength of the light. The processor 27 determines the film thickness of the wafer W based on the spectral waveform according to the method discussed with reference to FIG. 5 and FIG. 6. The processor 27 can determine an accurate film thickness of the wafer W because the spectral waveform is produced based on the corrected intensities of light.

According to this embodiment, the reflected light from the wafer W is corrected based on the intensity G(λ), i.e., internal monitoring intensity, which is transmitted to the spectrometer 26 through the internal optical fiber 72 before polishing of the wafer W, instead of calibrating the optical film-thickness measuring device 25 with use of a calibration tool. Accordingly, it is unnecessary to calibrate the optical film-thickness measuring device 25.

The intensity G(λ) and the dark level D3(λ) may be measured each time a wafer is polished, or may be measured each time the predetermined number of wafers (for example, twenty-five wafers) are polished.

The quantity of light emitted by the light source 30 is gradually lowered with the operating time of the light source 30. When the quantity of light from the light source 30 is lowered to a certain extent, it is necessary to replace the light source 30 with new one. Thus, the processor 27 is configured to determine a service life of the light source 30 based on the intensity G(λ) of light transmitted to the spectrometer 26 through the internal optical fiber 72 before the wafer W is polished. More specifically, before the wafer W is polished, the processor 27 operates the optical-path selecting mechanism 70 to couple the internal optical fiber 72 to the spectrometer 26 so that the light emitted by the light-source 30 is transmitted to the spectrometer 26 through the internal optical fiber 72. The spectrometer 26 measures the intensity G(λ) of light transmitted through the internal optical fiber 72. The processor 27 compares the intensity G(λ) of light with a preset threshold value, and generates an alarm signal if the intensity G(λ) is lower than the threshold value.

The processor 27 may compare the intensity G(λ) at a predetermined wavelength λ with the threshold value, or may compare an average of the intensities G(λ) [λ=λ1 to λ2] at a predetermined wavelength range (from λ1 to λ2) with the threshold value, or may compare a maximum or a minimum of the intensities G(λ) [λ=λ1 to λ2] at the predetermined wavelength range (from λ1 to λ2) with the threshold value.

The intensity G(λ) is an intensity of light that is directly transmitted to the spectrometer 26 through the internal optical fiber 72, i.e., an internal monitoring intensity. In other words, the intensity G(λ) is an intensity of light that is not affected by the conditions of the wafer W and other optical paths. Therefore, the processor 27 can accurately determine the service life of the light source 30.

The processor 27 operates the optical-path selecting mechanism 70 before polishing of the wafer W to couple the internal optical fiber 72 to the spectrometer 26, and determines the service life of the light source 30 based on the intensity G(λ) of the light transmitted to the spectrometer 26 through the internal optical fiber 72. If the intensity G(λ) is lower than the threshold value, the processor 27 generates the alarm signal, and interlocks the polishing head 5 to prevent the polishing head 5 from starting polishing of the wafer W. Such interlock operation can avoid polishing of wafer W while measuring inaccurate film thickness. In this case, the wafer W is not polished, and is returned to a substrate cassette (not shown).

As shown in FIG. 1, the first optical sensor 61 and the second optical sensor 62 are disposed in the polishing table 3. A distance from the center of the polishing table 3 to the first optical sensor 61 is different from a distance from the center of the polishing table 3 to the second optical sensor 62. Therefore, the first optical sensor 61 and the second optical fiber 62 scans different zones of the surface of the wafer W each time the polishing table 3 makes one revolution. In order to properly evaluate the film thicknesses measured at the different zones of the wafer W, the first optical sensor 61 and the second optical sensor 62 are preferably under the same optical conditions. Specifically, the first optical sensor 61 and the second optical sensor 62 preferably illuminate the surface of the wafer W with light having the same intensity.

Figure 7:
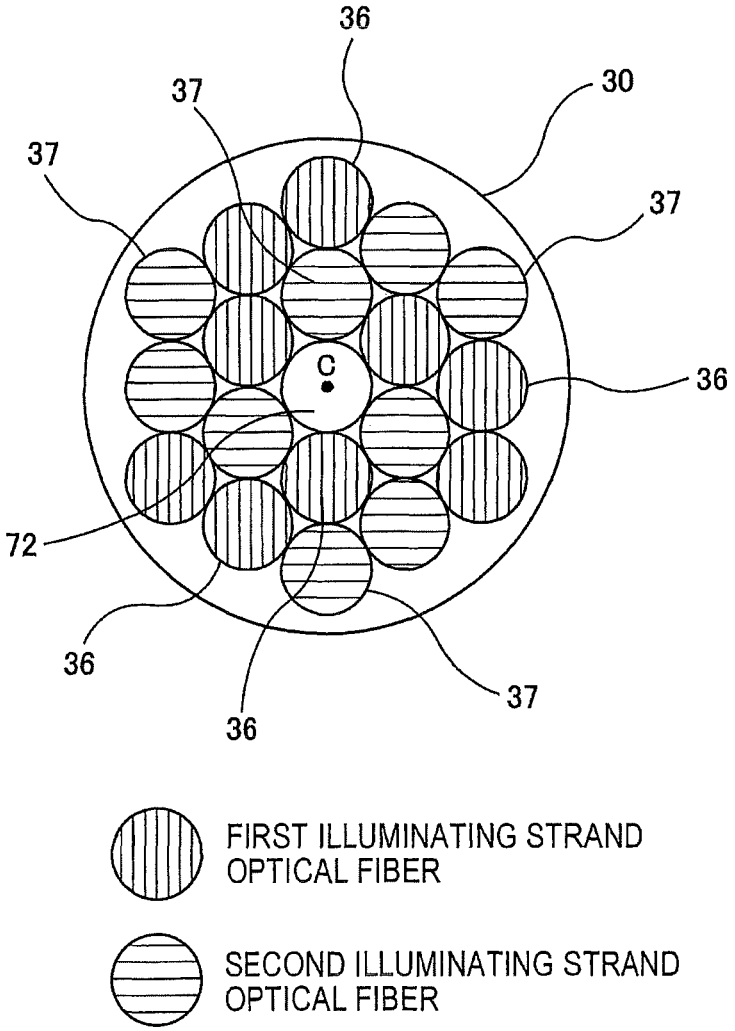
FIG. 7 is a schematic view showing an arrangement of light-source-side ends of first illuminating strand optical fibers and light-source-side ends of second illuminating strand optical fibers.

Thus, in one embodiment, the light-source-side ends of the first illuminating strand optical fibers 36 and the light-source-side ends of the second illuminating strand optical fibers 37, which constitute the first optical sensor 61 and the second optical sensor 62, are distributed evenly around a center C of the light source 30 as shown in FIG. 7. The number of light-source-side ends of the first illuminating strand optical fibers 36 is equal to the number of light-source-side ends of the second illuminating strand optical fibers 37. Further, an average of distances from the center C of the light source 30 to the light-source-side ends of the first illuminating strand optical fibers 36 is equal to an average of distances from the center C of the light source 30 to the light-source-side ends of the second illuminating strand optical fibers 37.

With such arrangement, the light emitted by the light source 30 travels through the first illuminating strand optical fibers 36 and the second illuminating strand optical fibers 37 evenly, and reaches the first optical sensor 61 and the second optical sensor 62. Therefore, the first optical sensor 61 and the second optical sensor 62 can emit the light having the same intensity to the different zones of the surface of wafer W.

In this embodiment, the internal optical fiber 72 is constituted by one strand optical fiber, and a light-source-side end of the internal optical fiber 72 is located at the center C of the light source 30. As described above, the internal optical fiber 72 is not used to illuminate the wafer W, and is used for correcting the intensity of the reflected light from the wafer W. Therefore, the intensity of light transmitted to the spectrometer 26 through the internal optical fiber 72 may be relatively low. From this viewpoint, the internal optical fiber 72 is constituted by one strand optical fiber. Since the intensity of light at the center C of the light source 30 is more stable than the intensity of light at an edge of the light source 30, the light-source-side end of the internal optical fiber 72 is preferably located at the center C of the light source 30 as shown in FIG. 7.

It is noted that the arrangement and the number of optical fibers 36, 37 shown in FIG. 7 are one example. The arrangement and the number of optical fibers 36, 37 are not limited particularly, so long as the light is evenly directed to the first optical sensor 61 and the second optical sensor 62 through the first illuminating strand optical fibers 36 and the second illuminating strand optical fibers 37, respectively.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table for supporting a polishing pad;

a polishing head configured to press a wafer against the polishing pad;

a light source configured to emit light;

an illuminating fiber having a distal end arranged at a predetermined position in the polishing table, the illuminating fiber being coupled to the light source;

a spectrometer configured to decompose reflected light from the wafer in accordance with at least one wavelength and measure an intensity of the reflected light at each of the at least one wavelengths;

a light-receiving fiber having a distal end arranged at the predetermined position in the polishing table, the light-receiving fiber being coupled to the spectrometer;

a processor configured to determine a film thickness of the wafer based on a spectral waveform indicating a relationship between the intensity of the reflected light and wavelength;

an internal optical fiber coupled to the light source; and an optical-path switch configured to selectively couple either the light-receiving fiber or the internal optical fiber to the spectrometer, the internal optical fiber having one end coupled to the light source and having an other end coupled to the optical-path selecting mechanism, wherein the processor stores therein, in advance, a correction formula for correcting the intensity of the reflected light, the correction formula being a function which includes, as variables, at least the intensity of the reflected light and an intensity of light transmitted to the spectrometer through the internal optical fiber.

2. The polishing apparatus according to claim 1, wherein the correction formula is represented by $$\text{a corrected intensity} = [E(\lambda) - D3(\lambda)] \Big/ \left[[B(\lambda) - D1(\lambda)] \times \frac{G(\lambda) - D3(\lambda)}{F(\lambda) - D2(\lambda)}\right]$$

where E(λ) is an intensity of the reflected light at a wavelength λ, B(λ) is a reference intensity at the wavelength λ, which is measured in advance, D1(λ) is a dark level at the wavelength λ obtained under a condition that light is cut off immediately before or immediately after the reference intensity B(λ) is measured, F(λ) is an intensity of the light at the wavelength λ transmitted to the spectrometer through the internal optical fiber immediately before or immediately after the reference intensity B(λ) is measured, D2(λ) is a dark level at the wavelength λ obtained under a condition that light is cut off immediately before or immediately after the intensity F(λ) is measured, G(λ) is an intensity of the light at the wavelength λ, transmitted to the spectrometer through the internal optical fiber before the intensity E(λ) is measured, and D3(λ) is a dark level at the wavelength λ obtained under a condition that light is cut off before the intensity E(λ) is measured, and immediately before or immediately after the intensity G(λ) is measured.

3. The polishing apparatus according to claim 2, wherein the reference intensity B(λ) is an intensity of the reflected light from a silicon wafer which is measured by the spectrometer when a silicon wafer with no film thereon is being water-polished in the presence of water on the polishing pad, or when a silicon wafer with no film thereon is placed on the polishing pad.

4. The polishing apparatus according to claim 3, wherein the reference intensity B(λ) is an average of multiple values of intensity of the reflected light from the silicon wafer, wherein the multiple values of intensity of the reflected light from the silicon wafer have been measured under at least one same condition.

5. The polishing apparatus according to claim 1, wherein the processor instructs the optical-path selecting mechanism to couple the internal optical fiber to the spectrometer before the wafer is polished.

6. The polishing apparatus according to claim 5, wherein the processor is configured to generate an alarm signal when the intensity of light transmitted to the spectrometer through the internal optical fiber is lower than a threshold value.

7. The polishing apparatus according to claim 1, wherein the illuminating fiber has a plurality of distal ends arranged at different locations in the polishing table, and the light-receiving fiber has a plurality of distal ends arranged at the different locations in the polishing table.

8. The polishing apparatus according to claim 7, wherein the illuminating fiber has a plurality of first illuminating strand optical fibers and a plurality of second illuminating strand optical fibers, and light-source-side ends of the plurality of first illuminating strand optical fibers and light-source-side ends of the plurality of second illuminating strand optical fibers are distributed evenly around a center of the light source.

9. The polishing apparatus according to claim 8, wherein an average of distances from the center of the light source to the light-source-side ends of the plurality of first illuminating strand optical fibers is equal to an average of distances from the center of the light source to the light-source-side ends of the plurality of second illuminating strand optical fibers.

10. The polishing apparatus according to claim 8, wherein a light-source-side end of the internal optical fiber is located at the center of the light source.

11. The polishing apparatus according to claim 8, wherein a part of the plurality of first illuminating strand optical fibers, a part of the plurality of second illuminating strand optical fibers, and a part of the internal optical fiber constitute a trunk fiber bound by a binder, and other part of the plurality of first illuminating strand optical fibers, other part of the plurality of second illuminating strand optical fibers, and other part of the internal optical fiber constitute branch fibers which branch off from the trunk fiber.

12. A polishing method comprising:

directing light from a light source to a spectrometer through an internal optical fiber without passing the light to a wafer to measure an intensity of the light, the light source being coupled to the spectrometer through the internal optical fiber;

pressing the wafer against a polishing pad on a polishing table to polish the wafer;

during polishing of the wafer, directing light to the wafer and measuring an intensity of reflected light from the wafer;

correcting the intensity of reflected light from the wafer using a correction formula which is a function including, as variables, at least the intensity of the reflected light and the intensity of the light transmitted to the spectrometer through the internal optical fiber; and determining a film thickness of the wafer based on a spectral waveform indicating a relationship between the corrected intensity and wavelength of light.

13. The polishing method according to claim 12, wherein the correction formula represented by $$\text{the corrected intensity} = [E(\lambda) - D3(\lambda)] \Big/ \left[[B(\lambda) - D1(\lambda)] \times \frac{G(\lambda) - D3(\lambda)}{F(\lambda) - D2(\lambda)}\right]$$

where E(λ) is an intensity of the reflected light at a wavelength λ, B(λ) is a reference intensity at the wavelength λ, which is measured in advance, D1(λ) is a dark level at the wavelength λ obtained under a condition that light is cut off immediately before or immediately after the reference intensity B(λ) is measured, F(λ) is an intensity of the light at the wavelength λ, transmitted to the spectrometer through the internal optical fiber immediately before or immediately after the reference intensity B(λ) is measured, D2(λ) is a dark level at the wavelength λ, obtained under a condition that light is cut off immediately before or immediately after the intensity F(λ) is measured, G(λ) is an intensity of the light at the wavelength λ, transmitted to the spectrometer through the internal optical fiber before the intensity E(λ) is measured, and D3(λ) is a dark level at the wavelength λ, obtained under a condition that light is cut off before the intensity E(λ) is measured, and immediately before or immediately after the intensity G(λ) is measured.

14. The polishing method according to claim 13, wherein the reference intensity B(λ) is an intensity of the reflected light from a silicon wafer which is measured by the spectrometer when a silicon wafer with no film thereon is being water-polished in the presence of water on the polishing pad, or when a silicon wafer with no film thereon is placed on the polishing pad.

15. The polishing method according to claim 14, wherein the reference intensity B(λ) is an average of multiple values of intensity of the reflected light from the silicon wafer which have been measured under the same condition.

16. The polishing method according to claim 12, wherein the process of directing the light from the light source to the spectrometer through the internal optical fiber to measure the intensity of light is performed before polishing of the wafer.

17. The polishing method according to claim 12, further comprising:

generating an alarm signal when the intensity of light transmitted to the spectrometer through the internal optical fiber is lower than a threshold value.

18. The polishing method according to claim 17, wherein if the intensity of the light is lower than the threshold value, the wafer is returned to a substrate cassette without performing polishing of the wafer.

* * * * *